US007513384B2

(12) United States Patent
Morris, Sr.

(10) Patent No.: US 7,513,384 B2
(45) Date of Patent: Apr. 7, 2009

(54) OPEN ENDED CONTAINER HAVING LOCKING LID

(75) Inventor: Glenn H. Morris, Sr., Elder Mountain, TN (US)

(73) Assignee: M & M Industries, Inc., Chattanooga, TN (US)

( * ) Notice: Subject to any disclaimer, the term of this patent is extended or adjusted under 35 U.S.C. 154(b) by 414 days.

(21) Appl. No.: 11/208,840

(22) Filed: Aug. 22, 2005

(65) Prior Publication Data

US 2007/0039964 A1 Feb. 22, 2007

(51) Int. Cl.
*B65D 41/06* (2006.01)

(52) U.S. Cl. ..... 220/302; 220/328; 215/330; 215/220; 215/216

(58) Field of Classification Search ..... 220/302, 220/306; 215/330, 220, 216
See application file for complete search history.

(56) References Cited

U.S. PATENT DOCUMENTS 2,866,574 A * 12/1958 Roumeliotis ..... 220/326
3,376,992 A * 4/1968 Klapp, Sr. ..... 215/216
3,514,003 A * 5/1970 Fitzgerald ..... 215/221
3,612,323 A * 10/1971 Malick ..... 215/214
3,744,655 A * 7/1973 Nixdorff, Jr. ..... 215/216
3,844,438 A * 10/1974 St. Pierre et al. ..... 215/221
3,902,620 A * 9/1975 McIntosh ..... 215/209
4,053,077 A * 10/1977 DeFelice ..... 215/217
4,512,484 A * 4/1985 Mar ..... 215/221
4,732,288 A * 3/1988 Morris, Sr. ..... 215/214
4,967,926 A * 11/1990 Morris, Sr. ..... 220/323
4,989,739 A * 2/1991 Falcone et al. ..... 215/221
5,027,954 A * 7/1991 Hickerson ..... 215/201
5,058,754 A * 10/1991 Hickerson ..... 215/201
5,125,538 A * 6/1992 Morris, Sr. ..... 222/143
5,224,615 A * 7/1993 Hickerson ..... 215/218
5,377,858 A * 1/1995 Morris, Sr. ..... 220/254.8
5,520,296 A * 5/1996 Freed ..... 215/206
5,544,768 A * 8/1996 Gargione ..... 215/209
5,664,693 A * 9/1997 Krall ..... 215/209
5,788,098 A * 8/1998 Mader ..... 215/219
5,816,422 A * 10/1998 Roig ..... 215/209
5,915,575 A * 6/1999 Morris, Sr. ..... 215/214
5,941,402 A * 8/1999 Krueger ..... 215/209
6,006,942 A * 12/1999 Morris et al. ..... 220/288
6,039,196 A * 3/2000 Ekkert et al. ..... 215/216
6,105,809 A * 8/2000 Yamanaka ..... 220/326
6,176,381 B1 * 1/2001 Mader ..... 215/219
6,776,302 B2 * 8/2004 Morris, Sr. ..... 220/288
6,926,165 B2 * 8/2005 Conti ..... 220/288
6,983,859 B2 * 1/2006 Azzarello ..... 220/288

* cited by examiner

*Primary Examiner*—Anthony D Stashick
*Assistant Examiner*—Christopher B McKinley
(74) *Attorney, Agent, or Firm*—Stephen J. Stark; Miller & Martin PLLC

(57) ABSTRACT

A container assembly having a lid which connects to an open container. A locking mechanism is employed which preferably includes a slide which cooperates with at least one stop connected to the lid wherein movement of the slide relative to the lid is preferably utilized to disengage the locking mechanism to allow the lid to be unscrewed relative to the container.

18 Claims, 2 Drawing Sheets

OPEN ENDED CONTAINER HAVING LOCKING LID

FIELD OF THE INVENTION

The present invention relates to a threaded closure assembly, and more particularly to an open ended container having a lid lockable with at least one moveable locking member.

DESCRIPTION OF RELATED ART

Many resources have been invented to provide improved locking lid which cooperates with an open end container. U.S. Pat. Nos. 4,732,288, 4,967,926, 5,125,538, 5,377,858, 5,915,575, 6,006,942 and 6,776,302 show various locking lid pail containers. Many of these prior art designs have been created by the applicant. These prior art designs are useful for their intended purpose, however, the various designs continue to be improved upon for different applications over time.

In all these prior art designs, the movable locking member is connected to the lid. The stop which is normally provided as a portion of teeth are provided on an exterior or interior surface of the pail. While numerous effective designs can be created as is known in the prior art from construction of utilizing teeth and/or stops on the pail, there is believed to be a perceived need for another design which does not rely on stops or teeth molded into the pail.

SUMMARY OF THE INVENTION

Consequently, it is an object of the present invention to provide a locking lid assembly for use with open ended containers wherein the container has the locking member connected to the container while the lid has at least one stop, if not a plurality of teeth with stops.

It is a further object of the present invention to provide a simple, effective locking system for use with open ended pails and lids.

It is another object of the present invention to provide a relatively simple pail and lid assembly which provides an effective mechanism to lock the lid relative to the pail.

Accordingly, a lid is formed having at least one stop and preferably a plurality of stops. Preferably, teeth having stops are molded as a portion of a lid such as by injection or blow molding. A locking member is connected to the container and is preferably operable by a user so that the locking member can be moved from a locked to an unlocked position and the lid can then be unscrewed from the container. In the preferred embodiment the locking member is biased into engagement with the teeth when the lid is screwed tight relative to the container thereby preventing rotation to remove the lid until the locking member is moved to the unlocked position.

The lid has inwardly directed threads and the top of the container having outwardly directed threads. These threads cooperate to allow the lid to be tightened relative to the container. A groove or slot assists in retaining a locking member so that a slide can move into and out of engagement with the stop or teeth of the lid. The stop or teeth preferably formed in a bottom,portion and/or an interior surface of the lid and are preferably directed downwardly.

When the locking member is moved out of engagement with the teeth it preferably slides in the groove.

In the preferred embodiment there is no need to move the locking member out of engagement with the stops when securing the lid relative to the container since the teeth and locking member preferably have a slanted ramp surface opposite a stop so that during the installation of the lid the locking member is moved out of position by the ramp surfaces acting against the locking member. Should a user attempt to reverse direction of the lid relative to the container, the stop of the teeth would an abutment of the slide thereby preventing such rotation until the locking member is disengaged by the user.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
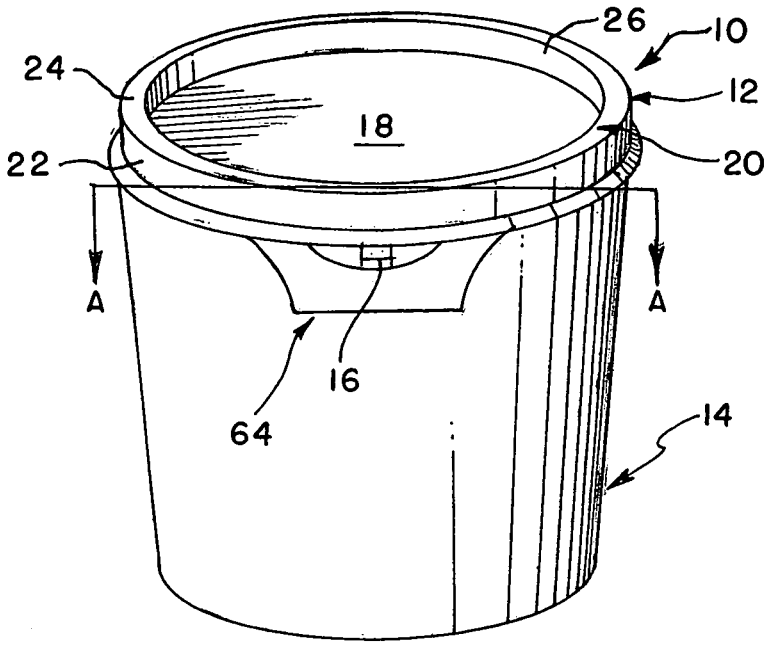
FIG. 1 is a top elevation view of an open ended container with a lid attached thereto of the presently preferred embodiment of the present invention.

FIG. 1 shows a container assembly 10 comprising a lid 12 and an open ended container 14. A locking mechanism 16 when in a locking configuration is useful to resist the removal of the lid 12 from the container 14 when the lid 12 has been connected to the container 14 in a fully closed configuration as illustrated in FIG. 1. Details of the operation of the locking mechanism 16 will be described in reference to FIGS. 2 through 4.

The lid 12 preferably has a center portion 18 surrounded by a ridge 20. The ridge 20 is defined and/or bounded by a downwardly extending outer wall 22. If the ridge 20 is not utilized, downwardly extending wall 22 may connect to and surround the center portion 18. The ridge 20 illustrated as formed from the downwardly extending outer wall 22, top portion 24 and inner wall 26. One or more shelves or steps may extend from the inner wall 24 to the center portion 18. The top portion 24 is preferably parallel to center portion 18. The outer wall 22 and inner wall 26 are illustrated as parallel to one another and perpendicular to the top portion 24.

Figure 2:
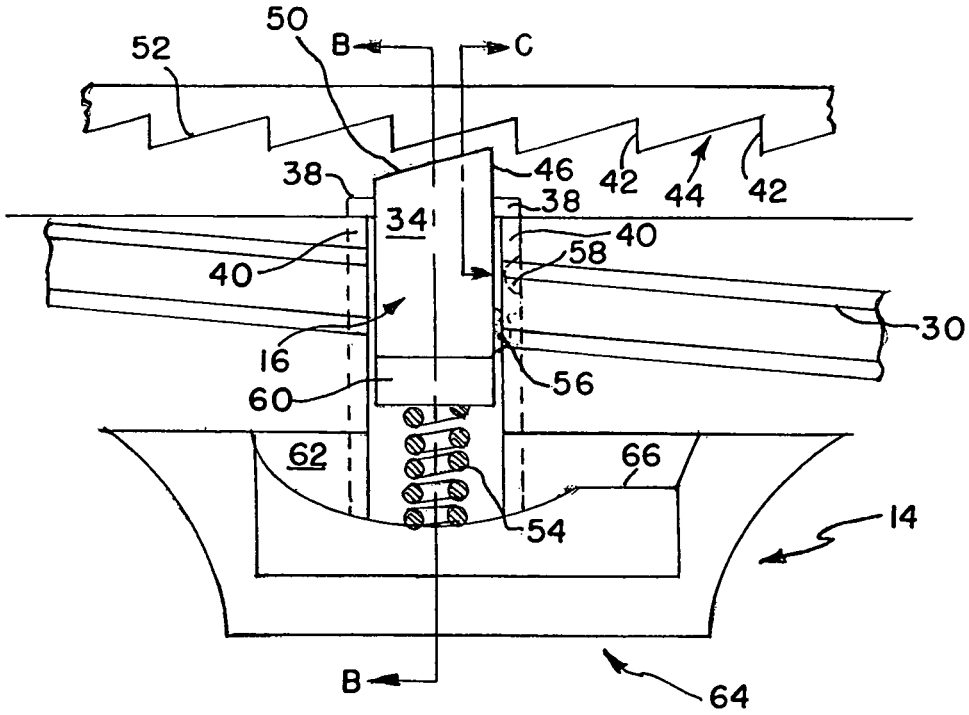
FIG. 2 is cross section taken along line A-A of FIG. 1.

FIG. 2 shows an upper rim 28 of the container 14 with the lid 12 slightly above it such as if the lid 12 were not fully tight relative to the container 14. Only a cross section of the lid 12 and container 14 are illustrated. Although threads 30 of the container are illustrated in this view threads 32 of the lid 12 are not visible in this view (see FIG. 3). Threads 32 cooperate with threads 30 so that the lid 12 can be tightened relative to the container 14 by rotating the lid 12 relative to the container (or vice versa). The cooperation of the threads 30,32 is illustrated in FIG. 3.

One feature which is believed to separate the present invention from prior art is that locking mechanism 16 operates differently than the prior art. Specifically, locking member or mechanism 16 is connected to the container 14 and engages one or more stops of the lid 12 (instead of vice versa, as is done in the prior art). Specifically, locking mechanism 16 is preferably comprised of a slide 34 which is disposed within a slot 36 in the container 14. Slot 36 may be molded or machined into the container. In the preferred embodiment the slot 36 is injection molded as a portion of the container.

The slot 36 is preferably wide enough to receive wings 38 of the slide 34. The wings 38 preferably are entrapped by lips 40 which assist in preventing the slide 34 from radial outward displacement out of the slot 36. The slide 34 preferably cooperates with the slot 36 preferably for linear movement into and out of engagement with one or more stops 42 which are preferably portions of teeth 44. Slide also preferably has abutment 46 which when contacts stop 42 prevents rotation in that direction. In order to disengage abutment from stop 42 the slide 34 of the locking mechanism 16 is preferably downwardly displaced so that the abutment 46 no longer contacts stop 42. At this point the lid 12 may be unscrewed relative to the container 14.

Figure 3:
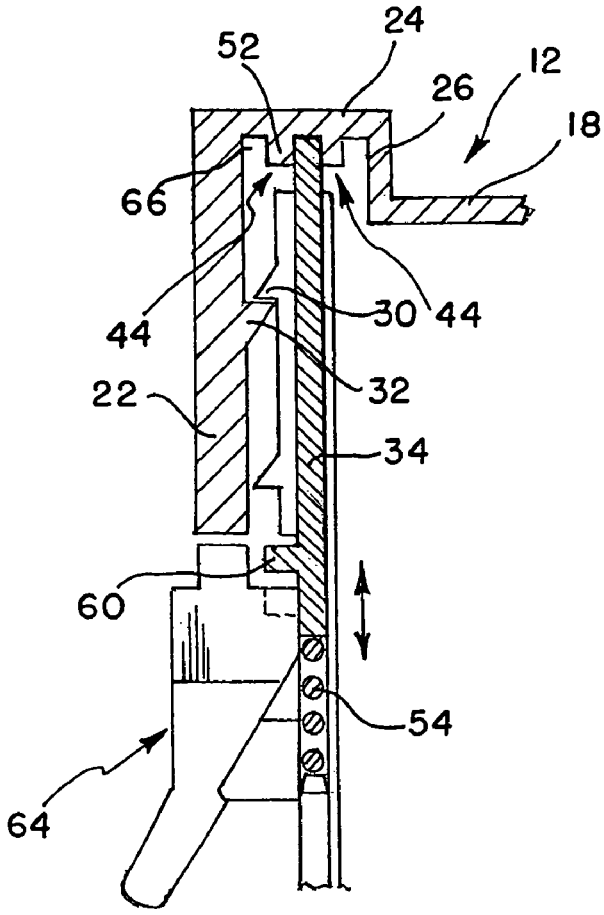
FIG. 3 is a cross section view taken along line B-B of FIG. 2.
Figure 4:
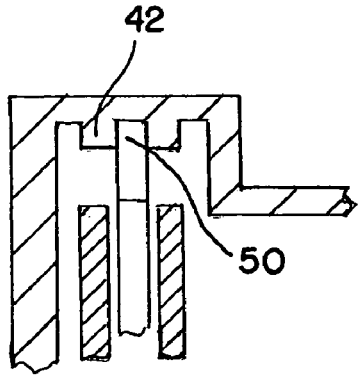
FIG. 4 is a cross section view taken along line C-C in FIG. 2.

FIGS. 2, 3, 4 illustrate the operation of the locking mechanism 16 in operation. FIG. 3 is a cross section taken along the lines B-B of FIG. 2 and FIG. 4 is a cross section taken along the lines of C-C. It would be obvious to one skilled in the art that the lid of the illustrated embodiment is attached by twisting the lid 12 counter clockwise relative to the pail 14 so that threads 30 engage threads 32 to thereby provide a lid in a closed configuration shown in FIG. 1.

As the lid 12 continues to be tightened relative to the container 14, the at least one stop 42 illustrated in the form of a portion of teeth 44 are directed towards the rim 28 of the top portion of the container 14. The front face 50 of slide 34 can contact ramp 52 of the teeth 44 so that the locking mechanism 16 does not prevent tightening of the lid 12 relative to the container 14 in the preferred embodiment. In this arid/or other embodiments, the locking mechanism 16 may be placed in the unlocked configuration to secure the lid 12 relative to the container 14. The angled surface 52 can cooperate with the front face 50 so that the slide 34 is displaced through the interaction of the angled surface 52 and front face 50 working against each other during the tightening process once the slide 34 contacts teeth 44 in the presently preferred embodiment. In this or in other embodiments it may be that the locking mechanism 16 is manually or otherwise displaced in order to allow further tightening once the slide 34 engages one or more of the teeth 44. The lid 12 shown fully tightened relative to the container 14 in FIG. 1. FIG. 3 shows the front face 50 acting against the angled surface 52 in contact therewith. FIG. 4 shows the interaction of the abutment (obscured from view) in contact with stop 42 which would prevent reverse rotation of the lid 12 relative to the container 14 unless the slide 34 is displaced so that the abutment 46 is no longer in contact with the stop 42 as has been described above.

Resilient member 54 is illustrated as a spring and is utilized to preferably bias the slide 34 towards the teeth. A finger 56 which is displaced during installation of the slide 34 relative to the container 14 is utilized to engage a shoulder 58 in the slot 36 once it passes thereby so that the shoulder 58 and finger 56 cooperate to retain the slide 34 in the slot 36 from further upward and outward removal. In other embodiments, the slide may or may not be constrained within the slot 36 to prevent inadvertent upward outward removal. Further mechanisms as are known in the art can assist in retaining slide 34 in the slot 36 and/or retaining other locking mechanisms 16 relative to the pail 14.

In order to operate the slide 34, an actuator 60 is preferably connected to the slide 34 which provides a location for a user's thumb or other finger to move the slide 34 so that the abutment 46 comes out of engagement with a stop 42 from a locking configuration to an unlocked configuration. The actuator 60 is preferably positioned so that a user can relatively easily move the actuator 60 to move the slide 34 to overcome the bias of resilient member 54 illustrated as a spring for such operation to allow the lid 12 to be placed in the unlocked configuration. The lid 12 may then be rotated to be opened or at least loosen the lid 12 relative to the container 14 if not completely disengage thread 30,32 so that the lid 12 can be removed relative to the container 14.

The locking mechanism 16 is preferably located in a strategic position so that it is easy to operate from a locked to an unlocked position such as described above. In the preferred embodiment a channel 62 is formed into a handle 64 which allows access to the actuator 60. In the preferred embodiment the location of the channel 62 is in a position which is approximately where a person would normally place his or her thumb when holding the pail by the handle 64. Shelf 66 may provide a location for the user to place his or her thumb when not disclosed within the channel 62. Handle 64 is located toward the rim 28, and the threads 30 are illustrated located intermediate the handle 64 and the rim 28. There may be sufficient room within the channel 62 to locate ones finger or thumb within the channel 62 without operating the locking mechanism 16.

Although only one handle 64 shown in FIGS. 1-3, it would be obvious to one skilled in the art that there would likely be another handle opposite the illustrated handle so that the two handles can carry the weight of the container assembly 10 along with any contents. In the preferred embodiment there is only one locking mechanism 16 but in other embodiments there could be one associated with each handle 64. Additionally, in other embodiments the locking mechanism 16 may be separately installed relative to handle 64. In yet other embodiments handle 64 may not be utilized while a locking mechanism 16 as shown and described herein could be.

Although the locking mechanism 16 in the presently preferred embodiment includes a slide 34 which operates within a slot 36, other locking mechanisms as known to those skilled in the art could also be utilized whether they travel linearly or nonlinearly as long as they cooperate with a stop connected to the lid 12.

In FIG. 3 the teeth 44 are illustrated depending downwardly from underside 66 of lid 12. In other embodiments it may be possible to extend radially or downwardly from the interior of exterior wall 22 or the exterior or interior wall 26. Furthermore, the teeth 44 may extend downwardly relative to an underside portion of the center 18.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A container assembly comprising:

an open ended container having outwardly directed threads on an outer exterior wall surface of the container and a groove in the exterior wall surface of the container;

a lid having a downwardly extending outer wall having inwardly directed threads and at least one stop connected to an interior surface of the lid, said inwardly directed threads of said lid configured to cooperate with the outwardly directed threads of said container to secure the lid relative to the container in a closed configuration and said at least one stop of the lid is located at least partially radially internal to the inwardly directed threads;

a locking mechanism operably coupled to the container, said locking mechanism having an abutment with an engaged and a disengaged configuration; and an operator operably coupled to the abutment with a slide and movement of the operator a predetermined distance moves the abutment to the disengaged position with the slide moving at least partially within the groove;

wherein when the lid is rotated from the closed configuration the abutment is biased to contacts at least one of the at least one stop in the engaged configuration, and movement of at least a portion of the locking mechanism to place it in the disengaged position moves the abutment out of contact with the at least one of the at least one stop.

2. The container assembly of claim 1 wherein the abutment moves linerarly from the engaged to the disengaged configuration.

3. The container assembly of claim 1 wherein at least a portion of the groove interrupts at least a portion of the outwardly directed threads.

4. The container of claim 1 wherein the groove further comprises at least one lip, said lip at least assisting in retaining the slide from outward displacement of the slide relative to the container.

5. The container of claim 1 wherein the abutment is biased into the engaged position with a spring member disposed at least partially within the groove.

6. The container of claim 1 wherein the at least one stop are portions of teeth disposed about a circumference of the interior surface of the lid.

7. The container of claim 6 wherein at least one of the teeth has a stop connected to an angled surface.

8. The container of claim 7 wherein when the lid is rotated from an open configuration to the closed configuration, the locking mechanism contacts angled surface but does not prevent further rotation to the closed configuration.

9. The container of claim 8 wherein the slide has an angled surface which cooperates with the angled surface of the teeth to allow rotation from the open to the closed configuration.

10. A container assembly comprising:

an open ended container having a groove and outwardly directed threads on an outer exterior wall surface of the container with at least a portion of the groove located at least above a portion of the threads;

a lid having a downwardly extending outer wall having inwardly directed threads and at least one stop connected to an interior surface of the lid, said inwardly directed threads of said lid configured to cooperate with the outwardly directed threads of said container to secure the lid relative to the container in a closed configuration; and a locking mechanism operably coupled to the container, said locking mechanism having an abutment with an engaged and a disengaged configuration and a slide which moves at least partially within the groove radially internally to the inwardly directed threads of the lid when the abutment moves from the engaged to the disengaged configuration; and wherein the lid is rotated from the closed configuration the abutment contacts at least one of the at least one stop in the engaged configuration, and movement of at least a portion of the locking mechanism to place it in the disengaged position moves the abutment out of contact with the at least one of the at least one stop.

11. The container of claim 10 further comprising an operator operably coupled to the abutment and movement of the operator a predetermined distance moves the abutment to the disengaged position.

12. The container of claim 10 wherein the groove is substantially linear and the slide moves at least substantially linearly from the engaged to the disengaged configuration.

13. The container of claim 12 wherein the groove is located in a top portion of the container.

14. The container of claim 13 wherein the groove is parallel to an axis of rotation of the lid relative to the container.

15. The container of claim 13 wherein the container has a rim above the threads and the groove terminates at the rim.

16. The container of claim 15 wherein the groove further comprises at least one lip, said lip at least assisting in retaining the slide from outward displacement of the slide relative to the container.

17. A container assembly comprising:

an open ended container having a groove and outwardly directed threads on an vertically extending outer exterior wall surface of the container;

a lid having a downwardly extending outer wall having inwardly directed threads and at least one stop connected to an interior surface of the lid, said at least one stop disposed at least partially radially internally relative to the inwardly directed threads and said inwardly directed threads of said lid configured to cooperate with the outwardly directed threads of said container to secure the lid relative to the container in a closed configuration; and a locking mechanism operably coupled to the container at least partially disposed in the groove, said locking mechanism having an abutment and an engaged and a disengaged configuration; wherein when the lid is rotated from the closed configuration the abutment contacts at least one of the at least one stop in the engaged configuration, and movement of at least a portion of the locking mechanism within the groove to place it in the disengaged position moves the abutment out of contact with the at least one of the at least one stop.

18. The container assembly of claim 17 wherein the at least one stop is a portion of one of a plurality of teeth disposed about the interior surface of the lid.

* * * * *